United States Patent [19]

Sauert

[11] 4,293,123

[45] Oct. 6, 1981

[54] BLOW LANCE

[75] Inventor: Fried Sauert, Bergisch-Gladbach, Fed. Rep. of Germany

[73] Assignee: Klöckner-Humboldt-Deutz AG, Fed. Rep. of Germany

[21] Appl. No.: 105,495

[22] Filed: Dec. 20, 1979

[30] Foreign Application Priority Data

Dec. 22, 1978 [DE] Fed. Rep. of Germany ..... 2855499

[51] Int. Cl.[3] ..... C21B 7/16

[52] U.S. Cl. ..... 266/268; 75/60; 266/265

[58] Field of Search ..... 266/268, 265; 75/60

[56] References Cited

U.S. PATENT DOCUMENTS

| | | | |
|---|---|---|---|
| 3,567,202 | 3/1971 | Mercatoris | 75/60 |
| 3,661,560 | 5/1972 | Grenfell | 75/60 |
| 3,819,165 | 6/1974 | Courard | 75/60 |

*Primary Examiner*—P. D. Rosenberg

*Attorney, Agent, or Firm*—Hill, Van Santen, Steadman, Chiara & Simpson

[57] ABSTRACT

A generally cylindrical lance is fitted with a nozzle block, extending into a recess formed at the downstream end of the lance. Within the lance are formed concentric gas feed tubes, which are placed in individual fluid communication with flow passages through the nozzle block. The nozzle block is sealingly connected to the open downstream ends of the gas feed tubes such that the mixture of gases from the respective tubes within the lance is prevented. The nozzle block is provided with an interchangeable jet nozzle element to provide a high-speed central gas flow. Located about the central nozzle, preferably in a concentric fashion, are outer nozzle means through which gas or gas mixtures pass at a relatively slower speed. Gases emerging from the nozzle block flow in a parallel fashion, such that the gases may mix or combine at the point of incidence on a molten bath surface. A flow change-over arrangement enables a different gas to be passed through at least one nozzle means as desired.

13 Claims, 3 Drawing Figures

BLOW LANCE

BACKGROUND OF THE INVENTION

A. Field of the Invention

The invention relates to the field of fluid spraying and more particularly to blow lance assemblies used in the treatment of molten material.

B. The Prior Art

Thermal treatment of molten material, such as metal, stone, slag, or the like, may include a gas conducting tube or lance to blow reaction gases onto the surface of the molten bath. For example, in steel-making, a lance may supply combustion gas or gases to sustain the oxidation process by which slag and steel are separated in a steel converter. A lance typically contains a central nozzle through which high pressure gas (e.g., greater than 10 barr) passes and which is surrounded by outer flow ports through which flows a further gas or gas mixture. The outer gas or gas mixture usually flows at a relatively lower volume rate than flow through the central nozzle. Since these lances are employed adjacent molten baths, they are usually provided with a water cooling system. In order to save energy, the exterior diameter of the lance is held to be as small as possible. Because gases conducted through the lance are combustible or support combustion, care must be taken in the design of the lance that ignitible mixtures do not form within the lance or that ignitible mixtures which do form are not ignited within the lance.

A known lance assembly for blowing gases against the surface of a molten metal bath is shown in German LP No. 845,643. There, a central nozzle is arranged perpendicularly to the bath surface and is surrounded by a ring of further nozzles whose axes extend radially outward at an angle from the central nozzle axis in the direction of fluid flow from the lance. The central nozzle delivers a relatively high volume flow rate of oxygen or oxygen-enriched air; whereas the diverging further nozzles conduct a slower flow of air or inert gas. The concentric arrangement of diverging nozzles serves to displace the layer of slag floating on the surface of the molten metal, thereby exposing the bare bath surface into direct contact with the central gas jet. All the nozzles are contained in a nozzle block which is equipped with flow channels for the passage of a cooling medium. A drawback with the lance as shown in German LP No. 845,643 is that the fixed cross-sectional area for the central nozzle limits the environments in which the lance assembly can be utilized. A further disadvantage arises in that the central gas flow cannot react with or be supplemented by the surrounding gas flows when the central gas strikes the bath surface.

SUMMARY OF THE PRESENT INVENTION

Within a lance used in a thermal treatment system for molten material, such as metal, stone, slag, or the like, there is formed a center feed tube and concentric outer tubes, all of which terminate short of a downstream end wall of the lance shell. A nozzle block fits within a recess in the downstream end of the lance such that the upstream end of the block sealingly abuts open ends of all of the tubes but for the outermost concentric tube. The outermost tube is left open-ended to define one leg of a counterflow path for cooling medium along the shell wall of the lance. Preferably, the block is welded to the tubes, so that no special seals are needed. The nozzle block is formed with center and at least one annularly spaced flow passage means, which are in fluid communication with the center and concentric tubes, respectively. The center passage is fitted with a jet nozzle element. The central nozzle element is removable and interchangeable with other such elements having different jet nozzle dimensions, in order to accommodate the lance to changing metallurgical demands or different processes or process stages. The annular passage means is of a constant cross-sectional area and unrestricted; however, this cross-sectional area is less than that of the concentric tubes which feed the annular passage means such that the annular passages serve as outer nozzle means. Gases from the central and outer nozzle means exit the lance in parallel, so that the gases may mix or be brought into reaction with one another when striking the surface of the molten bath.

Gas flows are conducted to the feed tubes within the lance by gas supply means. The gas supply means comprises pressurized gas reservoir means, supply lines extending from the reservoir means into connection with respective tubes, and flow control valves for each of the supply lines. At least one tube is provided with a flow junction connected with more than one supply line. The control valves can be operated so that a different gas or gas mixture can be passed through that tube. By this arrangement, for example, an inert gas can be blown through the tube during start-up or during dangerous operating conditions until system parameters permit change-over to reaction gas. Automatic control of the control valves enables the change-over to be initiated as a function of selected system parameters.

DESCRIPTION OF THE PREFERRED EMBODIMENTS

Those skilled in the art will readily appreciate that the lance assembly of the present invention has application in that many different types of treatments and processes. For purposes of the preferred embodiments, however, the lance assembly of the present invention will be described in terms of use in the thermal treatment of molten material, such as metal, stone, slag, or the like.

Figure 1:
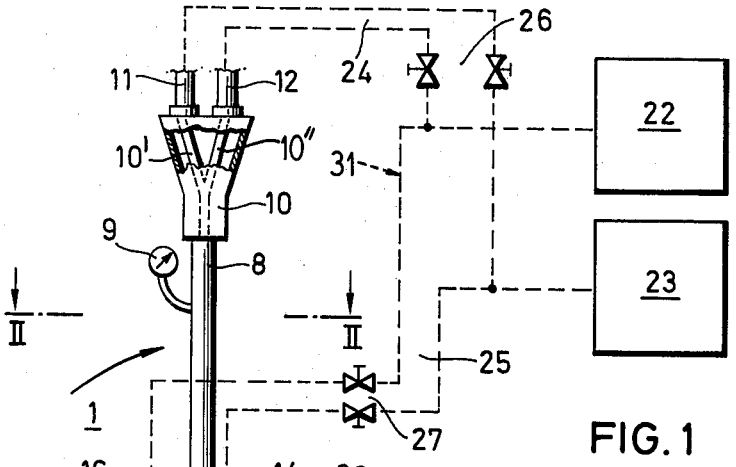
FIG. 1 is a broken vertical cross-sectional view, with parts in side elevation and in schematic of a lance assembly according to the present invention.

FIG. 1 shows a lance assembly 1 according to the present invention. The lance assembly 1 comprises a gas delivery lance 30 and a gas supply system 31. The lance 30 has a cylinder-like casing 17 with a frustro-connical downstream end wall formed with a central opening 32. Within the lance 30, there is formed a center feed tube 7 and a plurality of concentric outer tubes 13, 15, and 33. Tubes 7, 13, 15 and 33 extend from a circular plate 18, which serves as an upstream end wall for the lance 30, and terminate short of the downstream end wall to define a recess inside the central opening 32.

A cylindrical nozzle block 2 is fitted through the opening 32 and within the recess such that the upstream end wall of the nozzle block 2 sealingly abuts against the downstream outer ends of the tubes 7, 13, and 15. It is contemplated that the nozzle block 2 be fixably welded to the ends of the tubes 7, 13, and 15, so as to provide a seal connection without the need for special seal means. The nozzle block 2 contains a center channel 3 extending axially of the block 2. The upstream end of the center channel 3 is positioned in direct fluid communication with the downstream end of the center feed tube 7. The cross-sectional area of the center channel 3 is only slightly less than that of the center feed tube 7. Adjacent the downstream end of the nozzle block 2, the center channel 3 expands to form a recess for a removable central nozzle element 4.

The central nozzle element 4 contains a jet nozzle passageway in fluid communication with the upstream portion of the center channel 3 and having a restricted flow area portion 4' which is only slightly smaller than the cross-sectional area of the upstream portion of the channel 3. The central nozzle element 4 is preferably held in the nozzle block 2 by releasable connection means, like screw threads, so as to be interchangeable with other jet nozzle elements having different jet dimensions.

The nozzle block 2 is further formed with an outer channel means 5, extending coaxially with and spaced annularly about the axis of the center channel 3. The channel means 5 is of constant cross-section and extends from the upstream to the downstream side of the nozzle block 2. The upstream end of the channel means is in direct fluid communication with the feed tube 13. Also formed in the nozzle block 2 is another outer channel means 6, having a constant cross-sectional equal to that of the channel means 5. Channel means 6 serves to fluidly connect feed tube 15 with the downstream portion of channel means 5. The cross-sectional areas of the channel means 5 and 6 are less than that of the feed tubes 13 and 15, respectively. The outer channel means 5 and 6 comprise substantially continuous circular gaps; however, it is within the contemplation of the present invention for outer channel means to comprise a series of individual passages radially spaced from the center channel 3.

Extending above the circular plate 18 are connection tubes 8, 14, and 16 which communicate with the feed tubes 7, 13, and 15, respectively. Connection tube 8 may be equipped with a pressure gauge device 9 in order to monitor pressure in the center feed tube 7. The upstream outer end of the connection tube 8 is formed with a flow junction 10. The junction 10 includes a series of branch feed lines 10' and 10'' which connect at their downstream ends with the connection passage leading to the feed tube 7. Gas is supplied to the upstream end of the branch line 10' through a connection tube 11. Likewise, a different gas is supplied through a connection tube 12 into the upstream end of branch line 10''. If a third gas is to be added, a further identical flow mixer can be connected to the connection tube 11 such that a two-stage mixer is effected.

The gas supply system 31, as shown in FIG. 1, includes reservoirs 22 and 23 for pressurized gas. For purposes of the preferred embodiment, the gas in reservoir 22 is air or oxygen and the gas in reservoir 23 is fuel gas. A set of supply lines 24 and 25, illustrated with broken lines, serve to fluidly connect the reservoirs 22 and 23 with respective connection tubes. It has been found that flow from the central nozzle 4 is best provided when the flow cross-sectional area of the center feed tube 7 is only slightly greater than the cross section in the branch line 10' supplying fuel gas and branch line 10' cross section is insignificantly greater than the restricted portion 4' of the central nozzle 4. In this manner, a lower back pressure is produced in connection tube 12 than in connection tube 11. A set of flow control valves 26 and 27 are interposed along all of the supply lines. The flow control valve means 26 serve to enable a single gas from reservoir 22 or from reservoir 23 or a mixture of gases from the reservoirs to be supplied to the center feed tube 7 of the lance 30. It is within the contemplation of the present invention that the flow control valves 26 and 27 may be operated automatically, such as through electrical actuation.

The outermost concentric tube 33 mounted within the lance 30 defines a passage for the flow of a cooling agent, such as water. The cooling agent is supplied through a connection tube 20, which is situated on the circular plate 18 and fluidly communicates with the outermost tube passage 33. Since the downstream end of the outermost tube 33 is unobstructed by the nozzle block 2, cooling agent flows out from the outermost tube passage 33, against the downstream end wall of the lance 30, and returns along the interior surface of the casing 17 of the lance 30 toward the circular plate 18. Connection tube 19 situated on the circular plate 18 serves to conduct return flow of cooling agent from the lance 30. In this manner, tubular wall 21 acts as a dividing wall by which a counterflow arrangement of cooling medium is provided within the lance 30.

Figure 2:
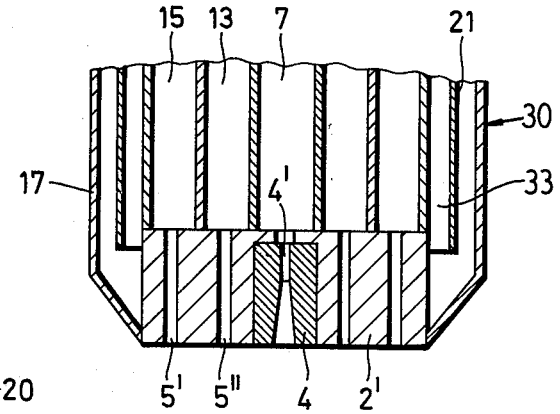
FIG. 2 is a transverse cross-sectional view taken along the lines II—II of FIG. 1.
Figure 2:
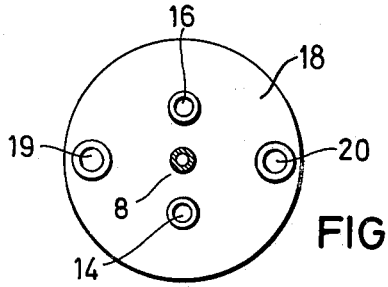

FIG. 2 illustrates the connection tubes 14, 16, 19, 20, and 8 in their preferable position along the circular plate 18. The connection tubes 14 and 16 have been offset in their side elevation depiction in FIG. 1, so as to enable a clear illustrative presentation of the present invention.

Operation of the lance assembly 1 may be described as follows. The lance 30 is positioned so that the nozzle block 2 faces an upper surface of molten material. Preferably, the center axis of the nozzle block 2 extends perpendicularly to the molten material surface. Reaction gas, i.e., oxygen or air, is supplied through center tube 7 to flow from the central jet nozzle element 4 to promote oxidation at the molten material surface. A mixture of gases, i.e., fuel gas and air or oxygen, is emitted from the annular channel means 5 which serves as an outer nozzle means. The relative mix of the gases emerging from the outer nozzle means depends on the setting for the control valves 27. If a mixture consisting of fuel gas and air or oxygen is conducted through the outer nozzle means, this mixture can be brought into combustion at the point of incidence of the gas flow from the central nozzle 4, so that an enhanced combustion is achieved there. The fact that the nozzle block 2 sealingly engages the feed tubes 7, 13, and 15 increases the operational security of the lance 30 since a formation of undesired mixtures within the lance 30 is safely prevented. The mixer 10 and control valve means 26 afford a change-over arrangement by which a different gas can be supplied to central feed tube 7 for passage from the central nozzle 4. The change-over arrangement enables an inert gas, which may be fuel gas, to be blown through the tube 7 instead of the reaction gas during start-up or when dangerous operating stakes occur. The use of automatic control means to regulate the control valves 26 enable the change-over to the flow of reaction gas through the center tube 7 to be initiated as a function of specific system parameters. For example, precompression, a pressure relationship or flow relationship of the respective gas streams to be mixed, a specific cooling agent exit temperature, or the like may be used as the system parameters to control the valve means 26. In this manner, operational safety of the lance 30 during start-up and dangerous operating conditions is afforded.

Figure 3:
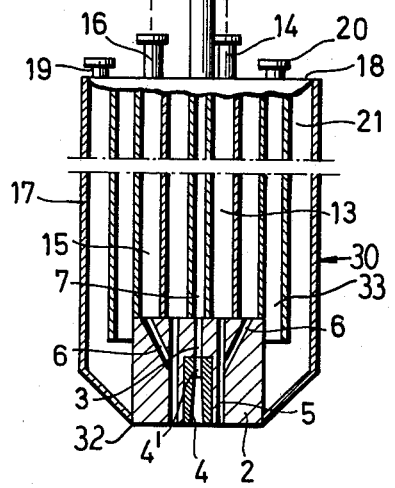
FIG. 3 is a fragmentary vertical cross-sectional view of an alternative embodiment to the lance of the present invention.

FIG. 3 illustrates an alternative nozzle block 2' in which the outer nozzle means comprises a series of concentric passages 5' and 5''. Each of the outer channel means 5' and 5'' comprises a substantially continuous circular gap of constant cross-section extending from the upstream to the downstream side of the nozzle block 2'. The channel means 5' and 5'' are in fluid communication at their upstream ends with concentric feed tubes 15 and 13, respectively. By this arrangement, gases passing through feed tubes 13 and 15 mix outside and downstream of nozzle block 2', rather than within the nozzle block.

Although various minor modifications may be suggested by those versed in the art, it should be understood that I wish to embody within the scope of the patent warranted hereon all such modifications as reasonably and properly come within the scope of my contribution to the art.

I claim as my invention:

1. A lance assembly for directing treatment gas flows onto the surface of a molten metal bath, said assembly comprising:

a lance comprised of a casing having mounted therein a plurality of concentric feed tubes and a separate nozzle block having channels therethrough in direct, sealed fluid communication with downstream ends of said feed tubes, a center channel in said nozzle block in fluid communication with a center feed tube, and a removable, interchangeable central nozzle means mounted in said nozzle block and having a passage therethrough to receive fluid from said center channel.

2. The assembly according to claim 1 further comprising:

at least one channel means in said nozzle block being spaced annularly about said center channel, said at least one channel means being of constant flow cross-section and in fluid communication with at least one concentric feed tube, so as to define an outer nozzle means with fluid flow therethrough being parallel to flow from said central nozzle passage.

3. The assembly according to claim 2 further comprising:

said at least one channel means comprising a substantially continuous annular gap.

4. The assembly according to claim 1 further comprising:

said nozzle block being connected to said feed tube downstream ends by welds.

5. The assembly according to claim 1 further comprising:

said central nozzle passage being a jet nozzle passage.

6. The assembly according to claim 1 further comprising:

a gas supply system connected to said center and concentric feed tubes for supplying gas flows thereto, said gas supply system comprising at least two different gas reservoirs and a flow junction means having branch lines connected to said flow system for fluidly connecting at least one feed tube to each of said gas reservoirs respectively.

7. The assembly according to claim 6 further comprising:

said at least one feed tube being said center tube.

8. The assembly according to claim 7 further comprising:

the flow cross-section of said center feed tube being not significantly greater than the flow cross-section of one of said branch lines and said one branch line flow cross-section being not significantly greater than the narrowest flow cross-section in said central nozzle passage.

9. The assembly according to claim 6 further comprising:

said gas supply system further comprising control valve means, said control valve means controlling gas flow into respective said branch lines such that said at least one feed tube may be alternately supplied with flow from each of the gas reservoirs.

10. The assembly according to claim 9 further comprising:

said at least one feed tube being said center feed tube.

11. The assembly according to claim 10 further comprising:

said gas reservoirs being two supply reservoirs, one containing fuel gas and the other containing an oxygen gas.

12. The assembly of claim 1, further comprising:

said channels directing gas flows therethrough for issuance from said nozzle block in parallel to flow from said central nozzle passage.

13. The assembly of claim 1, further comprising:

said channels comprising at least two substantially continuous annular gaps joining together in said nozzle block for issuance of common gas flow.

* * * * *